US005393363A

United States Patent [19]

Fournier

[11] Patent Number: 5,393,363

[45] Date of Patent: Feb. 28, 1995

[54] DEVICE FOR CONNECTING A DRAINING AND/OR INSULATING SCREEN WITHIN A TRENCH

[75] Inventor: Christian Fournier, Moissy-Cramayel, France

[73] Assignee: Fournier S.A., Limoges-Fourches, France

[21] Appl. No.: 867,056

[22] Filed: Apr. 10, 1992

[30] Foreign Application Priority Data

Apr. 12, 1991 [FR] France ..... 91 04480

[51] Int. Cl.[6] ..... H01B 13/06; H02G 15/08

[52] U.S. Cl. ..... 156/157; 156/159; 156/502; 156/505; 156/507

[58] Field of Search ..... 156/502, 505, 507, 49, 156/157, 159; 242/58.1

[56] References Cited

U.S. PATENT DOCUMENTS

| | | | |
|---|---|---|---|
| 2,444,075 | 7/1948 | Violette | 156/49 |
| 2,706,515 | 4/1955 | Evers | 156/505 X |
| 3,025,052 | 3/1962 | Gutteling | 271/94 |
| 3,549,458 | 12/1970 | Osta | 156/157 X |
| 3,577,302 | 5/1971 | Szakacs | 156/504 |
| 4,000,557 | 1/1977 | Bawden | 29/525 X |
| 4,157,208 | 6/1979 | Roberts | 339/98 X |
| 4,450,318 | 5/1984 | Scardina | 156/49 X |
| 4,481,053 | 11/1984 | Tokuno | 156/157 X |
| 4,561,924 | 12/1985 | Hope | 156/157 X |
| 4,757,951 | 7/1988 | Ludszeweit | 242/58.1 X |
| 4,849,580 | 7/1989 | Reuter | 156/49 X |
| 4,888,070 | 12/1989 | Clark | 156/49 X |
| 4,920,236 | 4/1990 | Makiyo | 156/49 X |
| 5,000,538 | 3/1991 | Jung | 350/96.21 X |

FOREIGN PATENT DOCUMENTS

| | | | |
|---|---|---|---|
| 2000351 | 9/1969 | France . | |
| 2591247 | 6/1987 | France . | |
| 1273950 | 7/1968 | Germany . | |
| 2138123 | 2/1973 | Germany . | |
| 2345983 | 4/1975 | Germany . | |
| 3902522 | 8/1990 | Germany . | |
| 0142312 | 5/1990 | Japan | 156/49 |
| 8204737 | 7/1982 | Netherlands . | |
| 2106873 | 4/1983 | United Kingdom . | |

*Primary Examiner*—David A. Simmons
*Assistant Examiner*—Charles Rainwater
*Attorney, Agent, or Firm*—Young & Thompson

[57] ABSTRACT

A sliding box for placing a film of insulating or draining material within a trench has a front section for receiving a roll of film and a rear section for delivery of the film into the trench. Between the front section (2) and the rear section (13), the box has a connecting chamber (4) provided at each end with a pair of rollers (5–6, 7–8) mounted within said chamber by means for varying the lateral spacing of the rollers of one and the same pair between an active position in which the two rollers grip the film (3) and a position of relative withdrawal in which the film passes freely between the rollers.

6 Claims, 6 Drawing Sheets

DEVICE FOR CONNECTING A DRAINING AND/OR INSULATING SCREEN WITHIN A TRENCH

The invention relates to the operation which consists in placing filtering or insulating material in the form of a thin film within a trench dug in the ground and more particularly to the problem of connection between two successive films when the reel from which the film is unwound into the trench is located within the trench itself.

In French patent No. 2,000,531, there is described a method of placing a film of this type within a trench by means of a vertical drum which carries the roll of film introduced in the trench at the rear of the excavating machine which is digging the trench, the film being directly unwound at its service location as the excavator moves forward.

In Dutch patent No. 82.04737, there is described a "cassette" containing the roll of film and constituting a box which is displaced in sliding motion at the rear of the excavating machine. The box has the double function of guiding the film as it is being unwound and of maintaining the opening of the trench while the unwinding operation is in progress.

A problem presented by this type of technique is the connection between two successive films and in particular the maintenance of water-tightness in the zone of junction between two successive films.

This problem is solved in accordance with the invention by the fact that the sliding box which contains the roll of film has an extension in the form of a connecting chamber provided at the ends thereof with two pairs of rollers synchronized in pairs and mounted on devices which are capable of varying the lateral spacing between two rollers of any one pair between two positions, namely a position of maximum spacing in which the film passes freely and a gripping position in which the film is driven by the two rollers of one and the same pair.

Thus at the time of laying of a roll of film as the excavating machine is traveling forward and pulling the film-laying box which is displaced in sliding motion within the trench, the film can pass freely from the magazine to the exit zone of the box through the connecting chamber.

When the film supply magazine is empty, the machine is stopped, a fresh reel is placed within the magazine whilst the pair of rollers located near the exit of the box within the connecting chamber has gripped and immobilized the end of the previous film and the pair of rollers located near the magazine draws the starting portion of the following film towards the end of the previous film. A special connecting member is then introduced into the connecting chamber and securely joins the two film ends together.

After this operation, both pairs of rollers of the connecting chamber can be withdrawn so as to allow the film to pass freely and thus to permit continuation of the film-laying operation as the excavating machine travels forward.

By making use of simple means, the invention accordingly makes it possible to work practically continuously and essentially to carry out film repairs during a laying operation in the event of any damage to the film.

This possibility of carrying out repairs or other work on the film within the trench permits the use of the method in trenches of substantial depth (over six meters), which had been out of the question up to the present time.

A better understanding of the invention will be gained from the following description of examples of construction which are given without any limitation being implied, reference being made to the accompanying drawings, in which.

Figure 1:
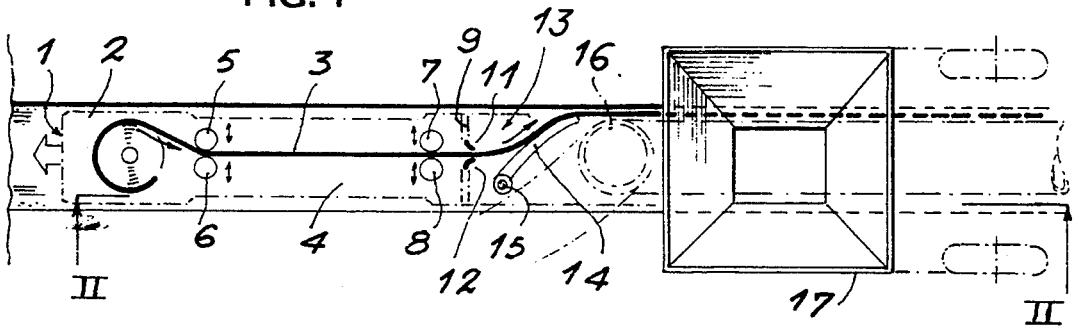
FIG. 1 is a general and diagrammatic top view of a sliding box in accordance with the invention.

Machines for digging trenches and laying a draining or insulating screen are well known. They usually consist of a caterpilllar designed to carry an orientable excavating chain or of a tractor which draws a trenching wheel, the entire assembly being followed by a box which is intended to slide within a trench in order to lay an insulating or draining film or a perforated pipe forming a drain at the bottom of a building pit and to discharge draining materials such as sand-gravel mixture, porous concrete or bentonite.

Machines of this type are well known and will therefore not be described in greater detail or illustrated in the accompanying drawings. The present description will be essentially concerned with the structure of the sliding box, whether the box is hitched or not to the rear of the excavating machine.

In accordance with the invention, the sliding box has a structure made up of three sections: a front section constituting a loading magazine for the film to be unwound, an intermediate section or so-called connecting chamber and a rear section constituting the zone of delivery of the film into the trench.

FIGS. 1 to 8 illustrate diagrammatically one example of execution of a connecting operation by means of a box in accordance with the invention.

In this example, the front section 2 of the box 1 constitutes a receiving chamber for a roll 3 of film mounted vertically within the box. The roll of film 3 is for example mounted to rotate freely on a mandrel carried by bearings, one bearing being located at the bottom of the box and the other bearing being located at the top. The top bearing is preferably removable so as to permit introduction and withdrawal of the rolls. Advantageously, when the roll of film 3 is in position within the magazine 2, the magazine is closed by a centering frame which ensures uniform and rectilinear unwinding of the roll of film.

At the exit of the magazine 2, the side walls of the box 1 become narrower and constitute a connecting chamber 4. At the entrance of said chamber 4, two vertical rollers 5 and 6 which can be motor-driven are mounted in bearings so as to be capable of lateral displacement towards each other, for example under the action of jacks (not shown), while at the same time rotating about their own axes. If they are motor-driven, the two rollers 5 and 6 are contrarotating and synchronized so that, when they are applied against the film 3, their respective movements do not produce any undesirable tension on said film but only a uniformly rectilinear traction in the direction of the exit of the box.

At the rear end of the chamber 4, a second pair of rollers 7 and 8 which is identical with the first and mounted in the same manner also serves to impart motion to the film 3.

Figure 2:
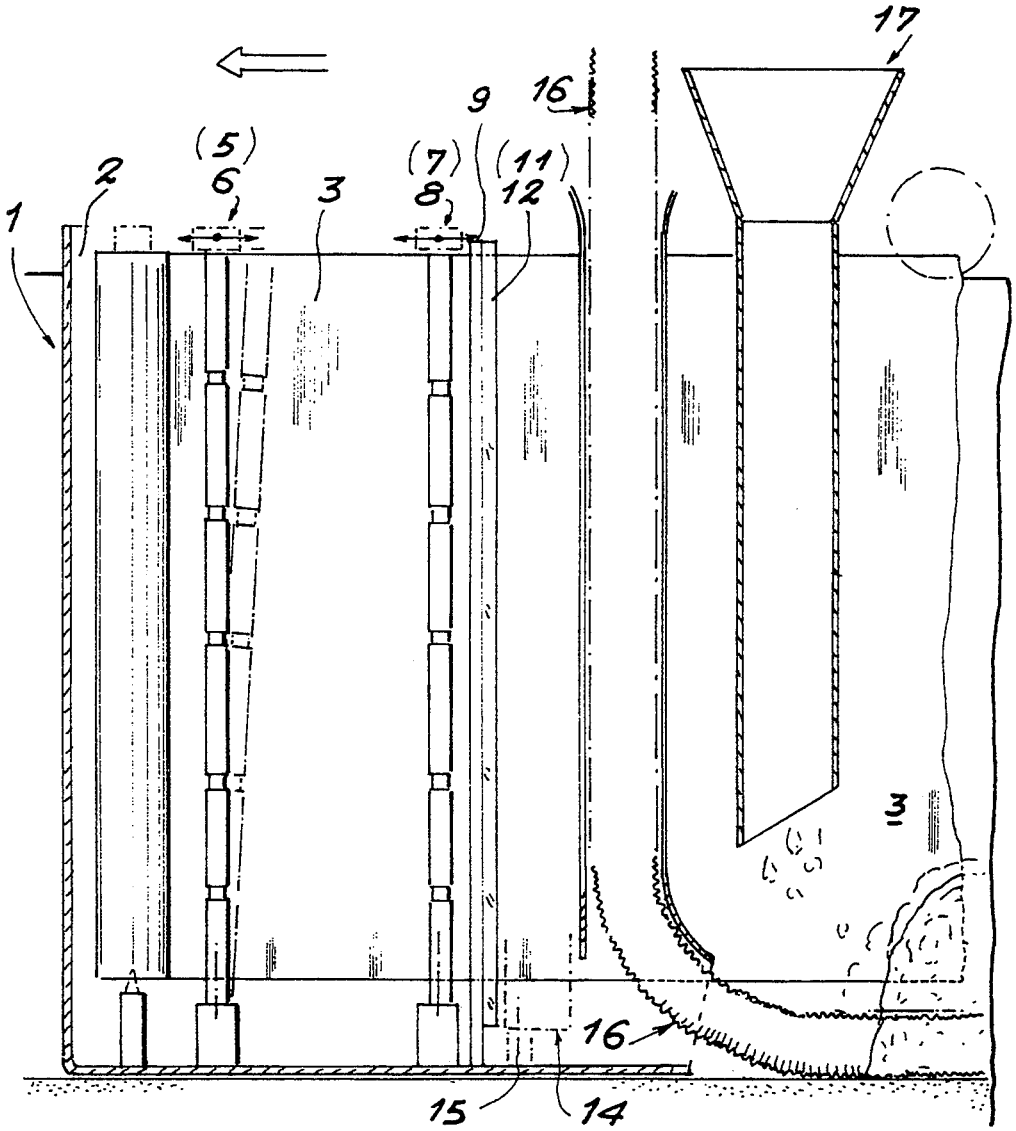
FIG. 2 is a vertical sectional view taken along line II—II of FIG. 1.
Figure 3:
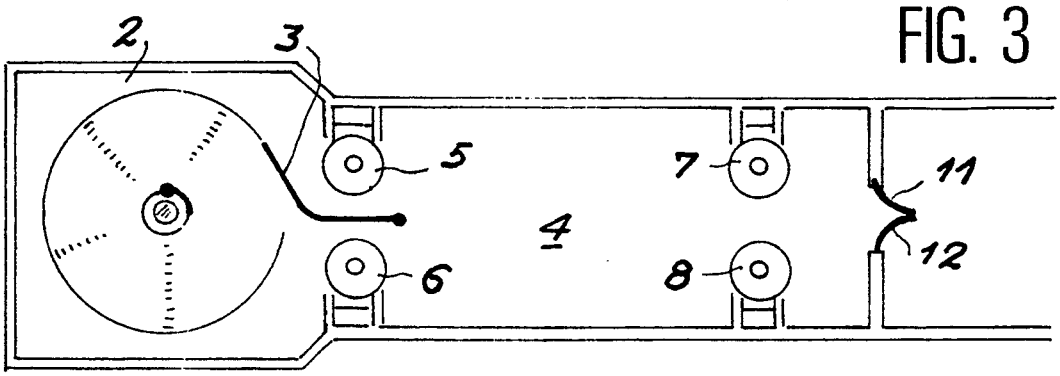
FIGS. 3 to 8 are top views showing diagrammatically the operations involved in making a connection between two films by means of a sliding box in accordance with the invention.
Figure 4:
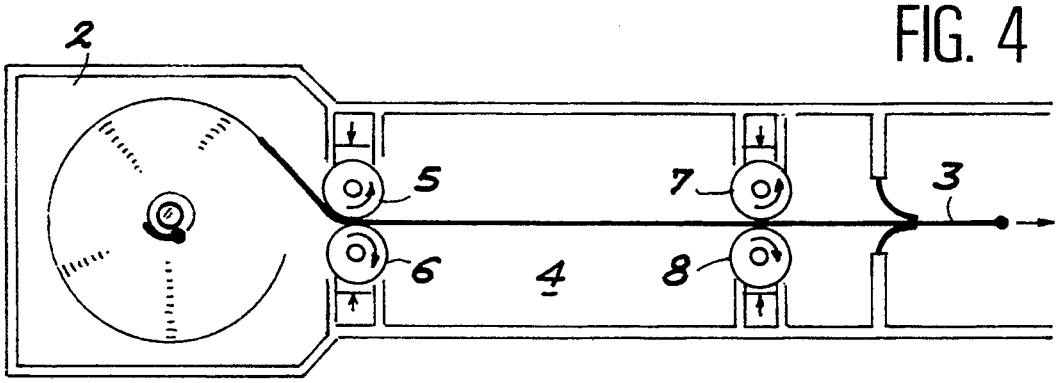
Figure 5:
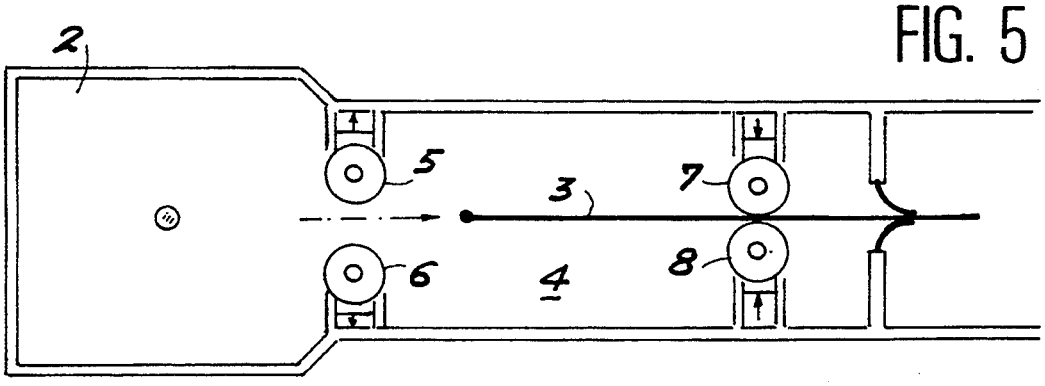
Figure 6:
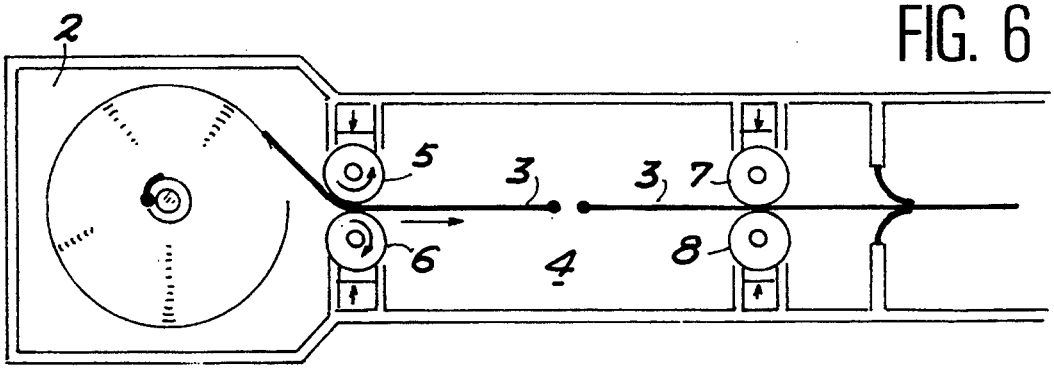
Figure 7:
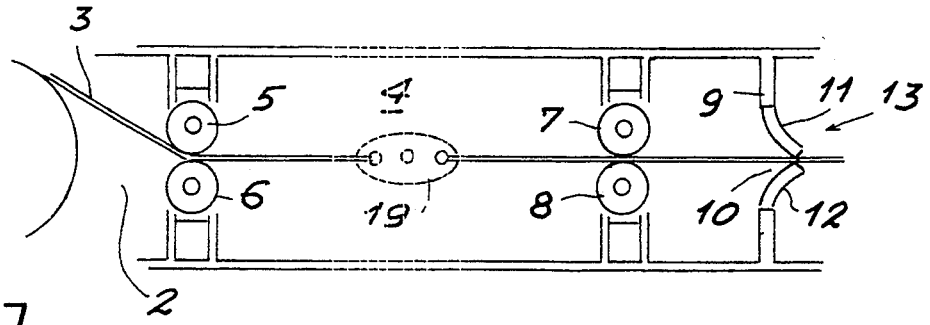
Figure 8:
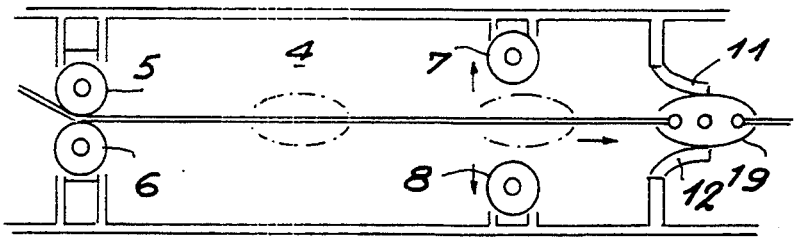

In FIG. 2, the rollers 5–6 and 7–8 are illustrated in the form of a set of rollers juxtaposed on a common shaft with interposition of bearings between the rollers of one and the same shaft.

By way of alternative, the rollers of any one shaft can be separated by collars which are placed around the shaft and serve to mount the shaft on jacks rigidly fixed to the wall of the box.

It is understood that, when they are in the withdrawn position close to the box wall which carries them, the rollers 5 and 6 are inactive and allow the film 3 as well as any overthickness which may technically be necessary to pass freely between them.

When they are applied against each other on each side of the film 3, said rollers have the function of guiding and/or displacing the film in the direction of the box exit.

A servocontrol system permits either joint or separate operation of the two pairs of vertical rollers 5–6 and 7–8. The rollers 5, 6, 7, 8 are normally vertical in the work position. It may prove useful, however, to allow them to assume an oblique position, especially when it proves necessary to compensate for differences in stretching of the film between its top portion and its bottom portion within the trench.

To this end, in accordance with an advantageous alternative embodiment of the invention, the rollers 5, 6, 7, 8 are each mounted on a beam which is in turn pivotally mounted on a horizontal shaft located at the bottom of the box and means are provided for locking each beam individually in a plurality of different positions according to the work site requirements. In FIG. 2, there is shown in chain-dotted lines an oblique position of the roller 5 and the arrows show the directions of possible pivotal displacements of the rollers 5–6 and 7–8 on each side of the vertical.

The exit of the chamber is closed by a transverse partition-wall 9 provided with a vertical slot 10 of sufficient width to provide a free passageway for the film 3 and for connecting means employed for joining two successive films together as will be described hereinafter.

The two edges of the slot 10 are provided with flexible lips 11 and 12 which ensure that the connecting chamber 4 is sealed, especially against penetration of water or mud which may be present within the trench.

At the rear of the connecting chamber 4, the box 1 has an exit zone 13 advantageously comprising a deflecting flap 14 pivotally mounted on a pin 15 located on either of the two side walls of the box. This deflector ensures that the film 3 is correctly applied on the edge of the trench.

The exit zone 13 can advantageously be fitted with a guide 16 for downward transfer of a drainage header-pipe and with a hopper 17 for discharging bulk material into the trench.

The sliding box in accordance with this first example of construction operates as follows:

When a fresh roll has been placed vertically on its bearings within the magazine 2, the starting end of the film 3 is passed between the first pair of rollers 5–6. These rollers are placed in contact with the film which is then transferred towards the exit zone. The film 3 then passes between the second pair of rollers 7–8. These rollers are in turn placed in contact with the film and cooperate with the first pair so as to ensure correct unwinding of the film by very uniform and rectilinear guiding and/or driving action.

When the end of a film is reached, the movement of the film as the end portion passes between the first pair of rollers 5–6 is detected for example by means of a warning band which is integral with the end portion of the film. By way of example, the warning band can consist of a metallic strip which is intended to pass in front of a light or sound alarm system and to actuate the system. More simply, it can be a colored band which gives a visual indication of the end of a film.

The machine is then stopped and the first pair of rollers 5–6 is caused to separate in order to permit positioning of a new reel within the magazine 2.

The starting end of said reel is passed between the first pair of rollers 5–6 and said rollers 5–6 are drawn together in order to grip and displace the starting portion of the new film to the vicinity of the end portion of the previous film. This end portion has been maintained in readiness within the chamber 4 by the second pair of rollers 7–8 which had been immobilized at the time of detection of the end-of-reel signal.

Connection between the two end portions of the film 3 is carried out by means of special connecting members inserted vertically within the connecting chamber 4.

In the example illustrated in FIGS. 1 to 8, each end portion of the film 3 is provided with a vertical rod 18 or with a beaded edge which forms a bearing element for the connecting member 19.

Figure 9:
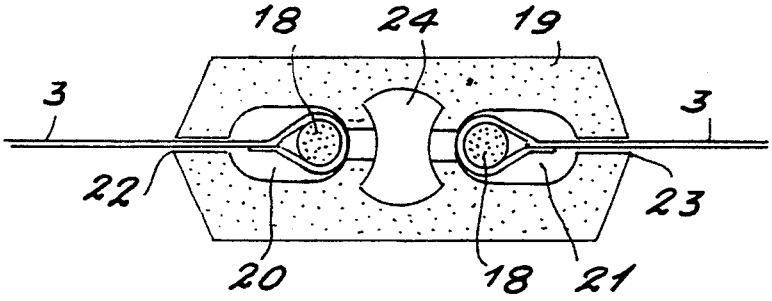
FIGS. 9 and 10 are diagrammatic sectional views of a first example of construction of a member which provides a connection between two films.

Said vertical rod can be molded in one piece with the edge of the film or mounted separately within a gusset formed by folding the film around the rod and bonding the pleat as shown in FIG. 9.

Figure 10:
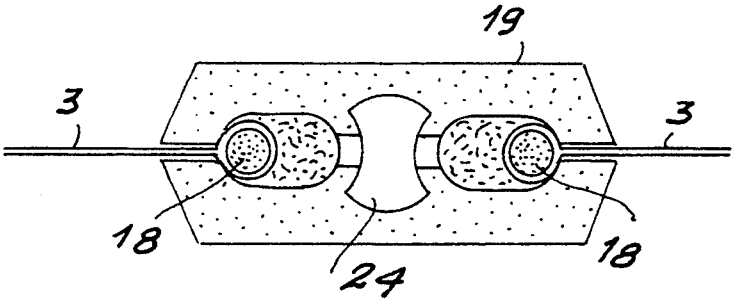
Figure 11:
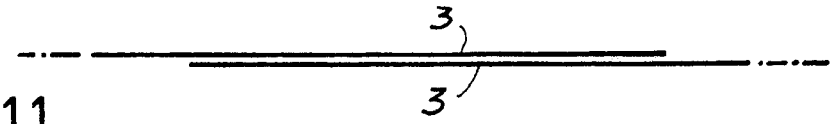
FIGS. 11 to 14 are diagrammatic sectional views showing the connection between two films with a second example of connecting member.
Figure 12:
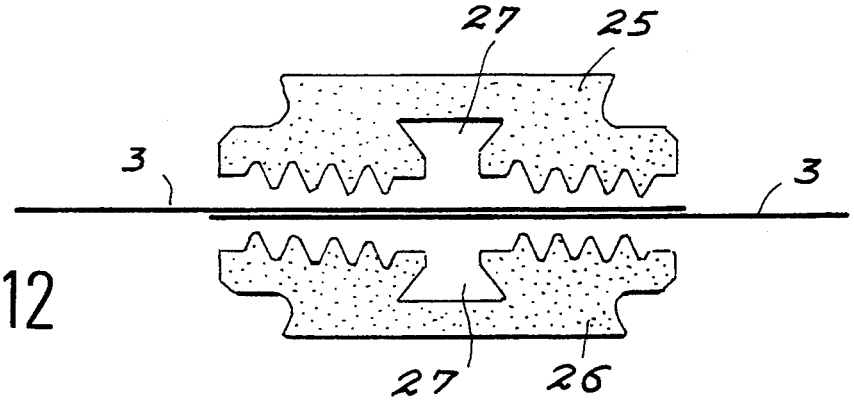
Figure 13:
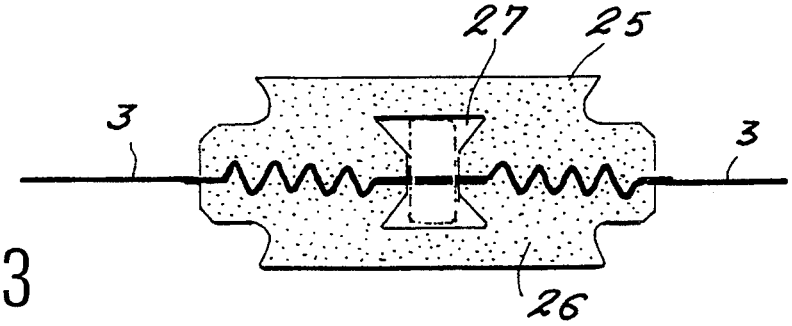
Figure 14:
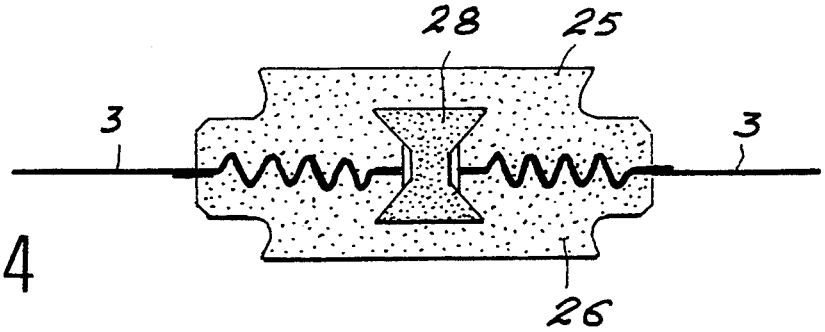

The connecting member 19 shown in cross-section in FIG. 10 is a sectional member of molded or injected material having two oblong cavities 20 and 21 which open at their opposite ends into a slot 22, 23 through which the film 3 is intended to pass. The cavities 20 and 21 have a sufficient depth to permit easy engagement of the connecting member 19 over the two end rods 18 of the two successive films.

Once this operation has been completed, the two films are put in tension by driving the two pairs of rollers 5–6 and 7–8 in opposite directions. The empty space of each cavity may be filled if necessary by injection of a sealing product such as bentonite or fast-setting polymer.

As an advantageous feature, the vertical sectional member has a central cavity 24 located between the two cavities 20 and 21 and provided over its entire length with radial ducts which open into the cavities 20 and 21.

Said central cavity is intended to be used for injection of the sealing product.

When the sealing product has completely set, the pair of rollers 7–8 which is close to the rear zone of the box is separated in order to allow the connecting member 19 to pass through, whereupon the rollers are re-applied against the film 3 and the film-unwinding operation is resumed.

In an alternative embodiment of the invention as shown in FIGS. 11 to 14, the film is not provided with any terminal rod or beaded edge, or else the connection is made as a result of rupture of the film 3.

In this case, when driving of the pair of rollers 7–8 has stopped, the two end portions of film 3 are superposed with a substantial overlap.

Two male-female members 25–26 having concordant sets of teeth along their plane of contact and provided with a central recess 27 which forms a housing for a key 28 are positioned on each side of the film 3 and maintained applied against each other, for example by means of claws provided within the connecting chamber 4. A cutting tool is lowered into the central recess 27 in order to cut the overlapping portion of the screen 3. A key 28 having a shape corresponding to that of the recess 27 is placed in position and serves to lock the two members 27 and 26 together and to grip the two ends of the film 3.

By way of alternative, the key 28 has a central recess for the injection of a sealing product.

As in the preceding embodiment, the rollers 7–8 are drawn apart in order to allow the connecting member 25–26 to pass through them, then again placed in contact for further unwinding of the film.

As will be readily apparent, the invention is not limited to the film-connecting means which have been described with reference to FIGS. 5 to 12. The connecting chamber in accordance with the invention permits the use of any type of means for fastening two ends of films together within a trench.

By means of its motor-driven rollers 5–6, 7–8 which are capable of rotating in two opposite directions, said connecting chamber makes it possible to ensure good stabilization of the two film ends, thus facilitating all subsequent film-fastening operations. For example, instead of the male and female members 25 and 26 of the example of construction shown in FIGS. 9 to 12, it is possible to make use of two jaws which apply a compressive force on the two film ends in their zone of overlap. While maintaining this compressive force, an ultrasonic bonding tool or any other known chemical or thermal means can be lowered along the film through an opening provided in the plane of contact of one of the compression jaws in order to form a bond between the two films over the entire distance from the bottom to the top of the trench.

Figure 15:
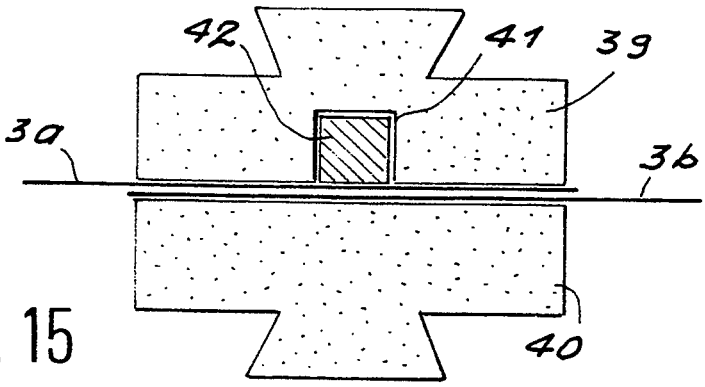
FIG. 15 is a diagrammatic sectional view showing another example of execution of the connection between two films.

A diagrammatic example of a device of this type is illustrated in FIG. 15, in which are shown the two jaws 39 and 40 with their smooth bearing faces, the opening 41 for the insertion of the bonding tool 42 within the jaw 39 and the two overlapping films 3*a*, 3*b* which are clamped between the jaws 39 and 40.

Figure 16:
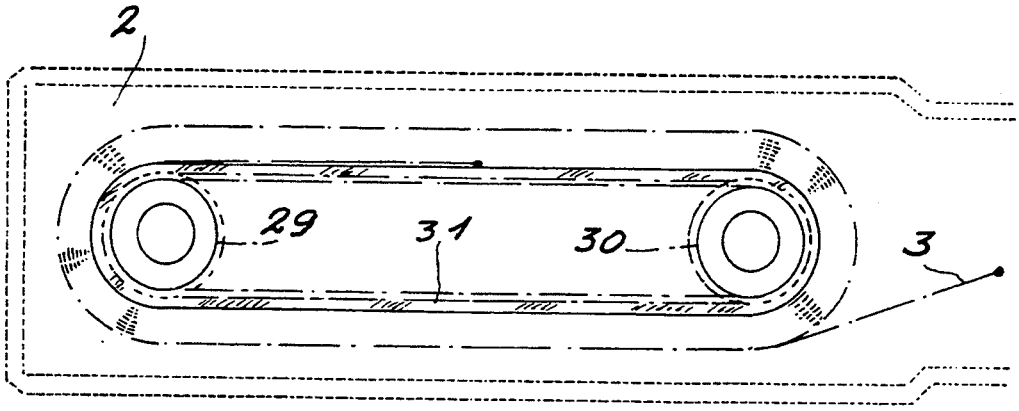
FIGS. 16 to 18 are diagrammatic top views illustrating alternative forms of construction of the front section of a sliding box in accordance with the invention.
Figure 17:
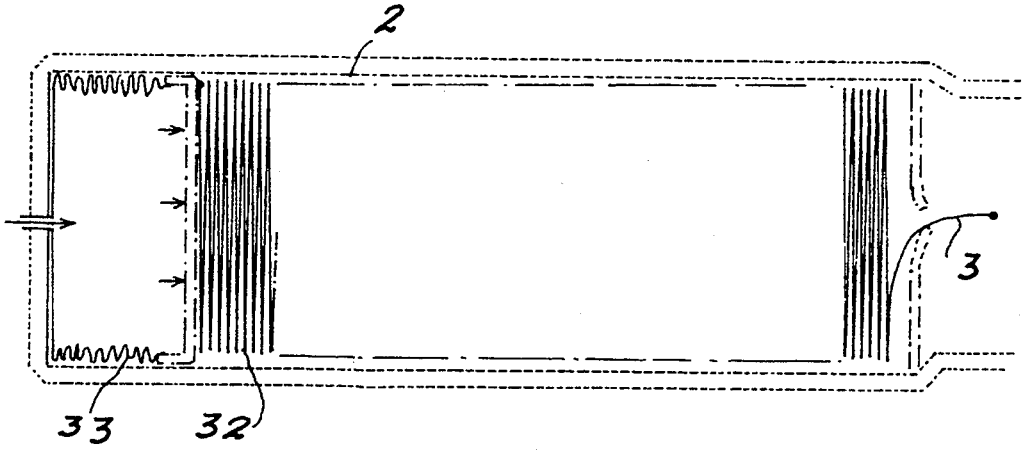
Figure 18:
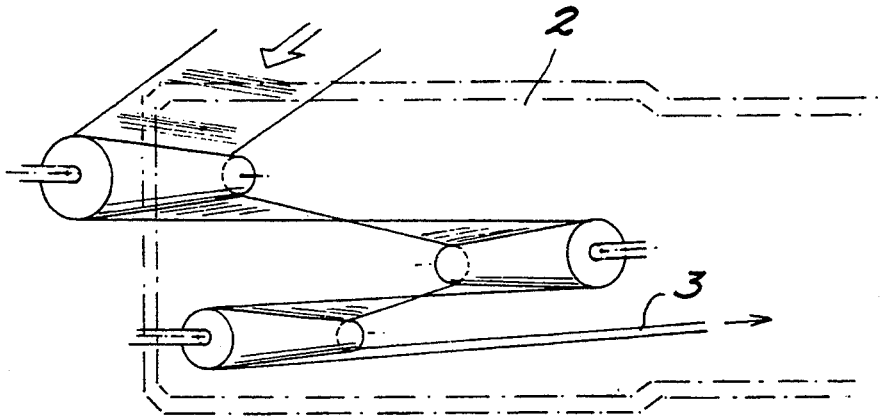

In FIGS. 16 to 18 are shown alternative forms of construction of a sliding box provided with a connecting chamber in accordance with the invention.

There is shown in FIG. 16 a variant of the film-supply magazine 2 in which the film is wound on two reels 29–30 located at a distance from each other. The two reels are surrounded by an unwinding band 31 forming a belt in order to guard against the phenomenon of self-tightening of the film 3 while it is being unwound.

This arrangement permits a high film storage capacity within a relatively small space.

FIG. 17 illustrates a magazine 2 in which the film 3 is stored in the form of accordion pleats 32. In this case, a pressure plate associated with a spring ensures progression of the film accordion within the magazine while it is being delivered.

By way of alternative, and as shown in FIG. 17, the magazine is fitted with an inflatable membrane 33 which ensures that a uniform pressure is exerted on the accordion during its delivery. This arrangement facilitates reloading of the magazine 2 after deflation of the membrane 33.

FIG. 18 illustrates another alternative mode of realization of the film supply. In this case, the front section 2 of the box is not strictly a magazine for the vertically-stored film but a section for receiving and guiding the film as it is being unwound from a reel located outside the trench.

In this case, the film 3 is folded-back around three stationary and substantially vertical guides carried by the box. This special film receiving and guiding arrangement is disclosed in a co-pending patent Application filed on the same day as the present Application.

Figure 19:
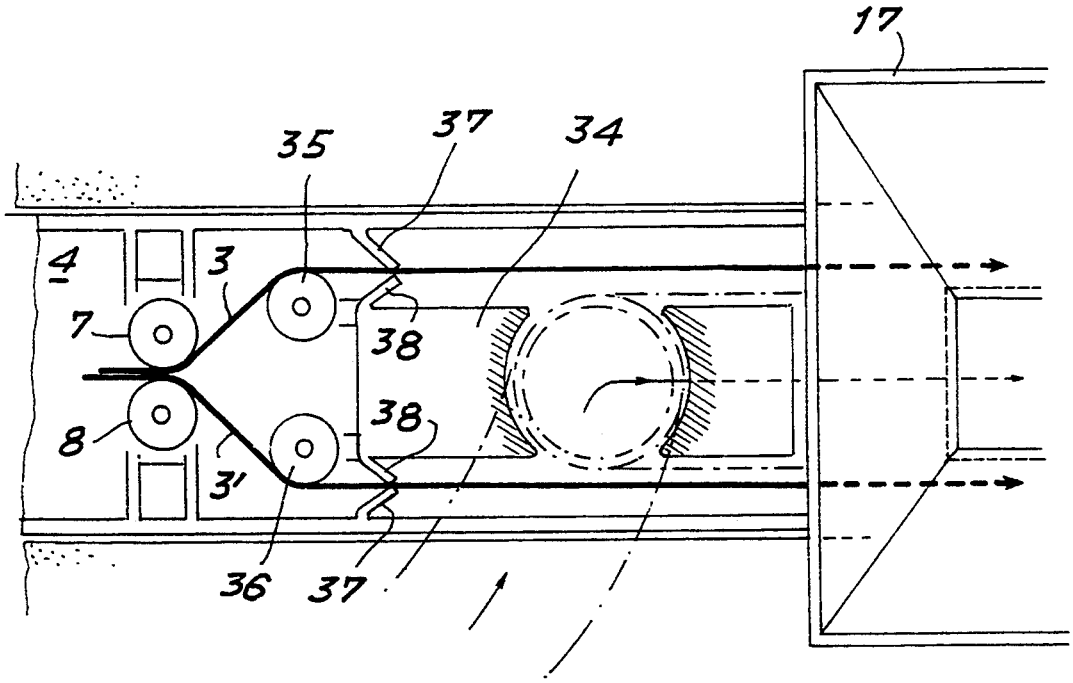
FIG. 19 is a diagrammatic top view illustrating an alternative form of construction of the rear section (delivery zone) of a sliding box in accordance with the invention.

FIG. 19 illustrates an alternative design of the exit zone 13 of the box in the event of delivery of two films at the same time, each film being intended to be applied against one wall of the trench.

In this case, the exit zone 13 carries a stationary central beam 34 having two vertical distribution rollers 35 and 36 mounted on the rear face of said beam and associated with two pairs of anti-return scraping seals 37 and 38. In this case, the films 3 and 3' pass directly from the rear pair of rollers 7–8 of the connecting chamber 4 onto the distribution rollers 35 and 36. In this embodiment, the partition-wall 9, the flexible seals 11–12 and the deflecting flap 14 of the previous examples of construction are dispensed with.

It can readily be understood that, when it is necessary to feed two separate films, the receiving chamber 2 must be equipped with a double bearing system for supporting two juxtaposed rolls of film.

The invention is not limited to the examples of construction which have been described in the foregoing. Other variants and details of construction may be employed without thereby departing from the scope of the invention.

For example, the rollers of the connecting chamber are covered with slightly compressible material such as rubber in order to be applied in intimate contact with the film over its entire width in the vertical plane, thus ensuring that the film is transferred without slippage.

The box can be equipped with light projectors in order to visualize the operations which take place within the box.

The box can be equipped with cameras which serve to transmit images of the interior of the box to a display screen located in the control station, thus permitting remote surveillance of the progress of operations.

The box can be equipped with a pump for sucking any mud-laden water which might seep-in despite the presence of the seals at the exit of the connecting chamber.

The bottom of the box can be fitted with a removable drawer for receiving and discharging mud and the like.

In order to limit frictional contact between the front section 2 which forms a magazine for rolls of film against the walls of the trench, said front section of the box can be of circular cross-section.

I claim:

1. In a process of placing a film of insulating or draining material in a trench by using a sliding box comprising a front section for receiving a roll of film and a rear section for delivery of the film into the trench, the method for joining-two ends of film of insulating or draining material comprising the following steps:

a. displacing said film into a connecting chamber by means of a first pair of contrarotating rollers applied against said film for transferring said film under traction up to a second pair of contrarotating rollers located at an extremity of said connecting chamber;

b. unwinding and driving regularly said film by either said first pair of rollers or said second pair of rollers;

c. stopping at least said first pair of rollers upon reaching the end of said film;

d. separating the rollers of said first pair in order to pass the starting end of a new film between the rollers of said first pair and drawing said rollers of said first pair together after the starting end of a new film has passed the rollers of said first pair;

e. gripping and displacing said starting end of a new film to the vicinity of the end portion of the previous film, which is maintained in readiness within said connecting chamber by said second pair of rollers; and f. inserting vertically a connecting member for connecting the two said ends of film.

2. A process according to claim 1, wherein each end portion of film is provided with a vertical rod or beaded edge adapted to cooperate with oblong cavities having open ends and formed in said connecting member.

3. A process according to claim 2, wherein said connecting member has a central cavity connected to the oblong cavities via radial ducts for the injection of a sealing product.

4. A process of connecting in a trench two ends of film of insulating or filtering material according to claim 1, wherein two jaws are provided within the connecting chamber with a view to compressing the zone of connection of two end portions of film, an opening being formed in the plane of contact of one of the jaws for the insertion of a bonding tool.

5. In a process of placing a film of insulating or draining material in a trench by using a sliding box comprising a front section for receiving a roll of film and a rear section for delivery of the film into the trench, the method for joining two ends of film of insulating or draining material comprising the following steps:

a. displacing said film into a connecting chamber by means of a first pair of contrarotating rollers applied against said film for transferring said film under traction up to a second pair of contrarotating rollers located at an extremity of said connecting chamber;

b. unwinding and driving regularly said film by either said first pair of rollers or said second pair of rollers;

c. stopping at least said first pair of rollers upon reaching the end of said film;

d. separating the rollers of said first pair in order to pass the starting end of a new film between the rollers of said first pair and drawing said rollers of said first pair together;

e. gripping and displacing said starting end of a new film to the vicinity of the end portion of the previous film, which is maintained in readiness within said connecting chamber by said second pair of rollers;

f. inserting vertically a connecting member for connecting the two said ends of film; and wherein said connecting member is made up of two male-female members having concordant sets of teeth along their line of contact and provided with a central recess forming a housing for a key.

6. A process according to claim 1, wherein each end portion of the film has an edge that extends full width of the film and that has a rod extending therealong or that is beaded and that is disposed in a cavity in said connecting member to retain the film ends in the connecting member.

* * * * *